US005974747A

United States Patent [19]

Perry

[11] Patent Number: 5,974,747

[45] Date of Patent: Nov. 2, 1999

[54] STRAW BALE BUILDING INCORPORATING A LIGHT WEIGHT REINFORCED STRUCTURE ND METHOD OF FABRICATING SAME

[75] Inventor: Anthony W. Perry, Santa Fe, N.Mex.

[73] Assignee: Chamisa Associates, LLC, Sante Fe, N.Mex.

[21] Appl. No.: 09/163,044

[22] Filed: Sep. 29, 1998

Related U.S. Application Data

[63] Continuation-in-part of application No. 08/802,415, Feb. 18, 1997, abandoned

[60] Provisional application No. 60/012,032, Feb. 21, 1996.

[51] Int. Cl.[6] ..... E04B 1/00

[52] U.S. Cl. ..... 52/270; 52/92.1; 52/262

[58] Field of Search ..... 52/92.1, 92.2, 52/92.3, 262, 264, 270, 284, 285.4, 286, 233, 295, DIG. 9, 582.1, 309.7, 586.1; 256/31, 24, 73

[56] References Cited

U.S. PATENT DOCUMENTS

| | | | |
|---|---|---|---|
| 225,065 | 3/1880 | Leeds | 52/405.1 |
| 312,375 | 2/1885 | Orr | 52/405.1 |
| 729,408 | 5/1903 | Pickin | 52/405.1 |
| 773,244 | 10/1904 | Brothers | 52/405.1 |
| 801,361 | 10/1905 | Clayton | 52/405.1 |
| 1,604,097 | 10/1926 | Hewlett | 52/405.1 |
| 1,633,702 | 6/1927 | Hewlett et al. | 52/405.1 |
| 3,160,249 | 12/1964 | Pavlecka | 52/586.2 |
| 3,922,832 | 12/1975 | Dicker | 52/742.1 |
| 5,172,528 | 12/1992 | Clarke | 52/198 |
| 5,398,472 | 3/1995 | Eichelkraut | 52/443 |
| 5,509,640 | 4/1996 | Vesper | 256/31 |
| 5,638,649 | 6/1997 | Hovland | 52/233 |
| 5,687,956 | 11/1997 | Vesper | 256/31 |

*Primary Examiner*—Beth Aubrey
*Attorney, Agent, or Firm*—Daniel Robbins

[57] ABSTRACT

A building has a support structure fabricated by anchoring light weight, hollow, vertical steel posts into a pre-poured foundation, and then strengthening the posts by filling the hollow cavities with concrete. The structure provides the framework around which straw bales are stacked to produce insulated wall cores for the building. The posts, which are sized to support the ceilings and roof trusses, are square in cross section and are positioned on a foundation so that the faces of the posts form 45 degree angles with the edges of the foundation slab. The center of the end faces of those straw bales that are in contact with a post are triangularly notched so that the corner of the post mates with the notch, allowing the longitudinal edge face of the bale to lie along the direction of the slab edge. Posts are not located at the corners of the building, but are spaced at least a bale's length away from a corner. This simplifies construction by allowing stacking of bales to form right angled wall structures at the corners without the need of sculpturing the corner bales. Also, there is no discontinuity of materials at the outboard wall surfaces when bales are in contact with a post, and hence, there is no requirement of special materials to bridge the seam formed by the two bales, as required by many building codes.

24 Claims, 5 Drawing Sheets

STRAW BALE BUILDING INCORPORATING A LIGHT WEIGHT REINFORCED STRUCTURE ND METHOD OF FABRICATING SAME

This application claims the benefit of U.S. provisional application Ser. No. 60/012,032 filed Feb. 21, 1996. This application is also a continuation-in-part of U.S. application Ser. No. 08/802,415 filed Feb. 18, 1997, now abandoned.

The U.S. Government has a paid-up license in this invention and the right in limited circumstances to require the patent owner to license others on reasonable terms as provided for by the terms of Contract No. 93-33610-9051 awarded by the Department of Agriculture.

BACKGROUND OF THE INVENTION

1. Field of the Invention

This invention relates to residential housing, and in particular to a low cost residential building using straw bale insulation, and the method for fabricating such a building.

2. Background Relative to the Prior Art

The need for low cost housing is a critical ongoing requirement in current society. With escalating costs of materials and labor, even the most modest of houses is now out of reach for many middle and low income families. Attempts to alleviate this problem by means of low interest mortgages, variable rate mortgages, kit homes or the substitution of trailers for conventionally constructed houses have been, at best, not completely satisfactory solutions. A more satisfactory solution requires attacking the root problem; namely, the high cost of home construction.

The largest component in the cost of home construction is labor, and it is estimated that labor accounts for about 65% of the construction cost. A viable method for reducing this cost is for the home owner to personally undertake as much of the home fabrication work as he can. This investment of time and effort in home construction by the owner, his family, and friends is colloquially known as "sweat equity".

To successfully implement such a program requires the use of manageable materials that can be physically handled by a small group of untrained individuals without the need of sophisticated, expensive tools and material handling equipment. A suitable material is straw which is light weight and compact, and has been used as insulation in home construction since time immemorial. Currently straw insulation is being used in the form of bales, the bales later being covered with plaster or interior wall board. In the prior art the use of straw bales has not materially reduced the cost of the resultant home. If the bales are incorporated into a conventional post-and-beam structure, the labor cost remains high. When conventional steel I-beams are used to implement the structure, the size and weight of the I-beams mandate the hiring of a crane, crane operator and other highly paid steel handling specialists to erect the building frame.

The present invention addresses the financial problem of home construction, and discloses low cost materials and building components to be used in building a house by a small group of untrained people without the need of complex tools and machinery, and with the goal of reducing the construction labor costs by as much as 30%.

SUMMARY OF THE INVENTION

The present invention discloses a residential building having a support structure fabricated by anchoring light weight, hollow, vertical steel posts into a pre-poured foundation, and then strengthening the posts by filling the hollow cavities with concrete. The structure provides the framework around which straw bales are stacked to produce insulated wall cores for the building. The posts, which are sized to support the ceilings and roof trusses, are square in cross section and are positioned on the foundation so that the faces of the posts form 45 degree angles with the edges of the foundation slab. The center of the end faces of those straw bales that are in contact with a post are triangularly notched so that the corner of the post mates with the notch, allowing the longitudinal edge face of the bale to lie along the direction of the slab edge. Because of the added strength imparted to the steel posts by the concrete filler, the posts may be spaced on 20' centers along the foundation. Posts are not located at the corners of the building, but are spaced at least a bale's length away from a corner. This simplifies construction by allowing stacking of bales to form right angled wall structures at the corners without the need of sculpturing the corner bales as would be required if the bales were to surround posts located at the corners. It will also be noted that the triangular notch in a bale only requires two intersecting saw cuts to form the notch, and that the end faces of two bales that contact a post from opposite directions along the slab are in facial contact at the post. This results in no discontinuity of materials at the outboard wall surfaces when bales are in contact with a post, and hence, there is no requirement of special materials to bridge the seam formed by the two bales, as required by many building codes.

The upper ends of the posts are provided with plates which serve as platforms for assemblies to which wooden ceiling joists and the roof trusses may be connected. Suitable assemblies are TJI wooden structures which mount directly on the plates and are secured to the plates by bolts having hooked metallic ends which clamp to the TJI structures. To keep the hooked ends from gouging the wood of the TJI structures, angle iron plates between the bolts' hooked ends and the TJI surface distribute the load over the surface of the TJI.

It will be noted that the materials and methods disclosed for the building of the invention do not require expensive tools or heavy equipment, and the home fabrication may be implemented by a small, relatively unskilled labor group with attendant labor cost savings.

BRIEF DESCRIPTION OF THE DRAWINGS

The invention will be described with respect to the drawings of which.

DESCRIPTION OF THE PREFERRED EMBODIMENTS

Figure 2:
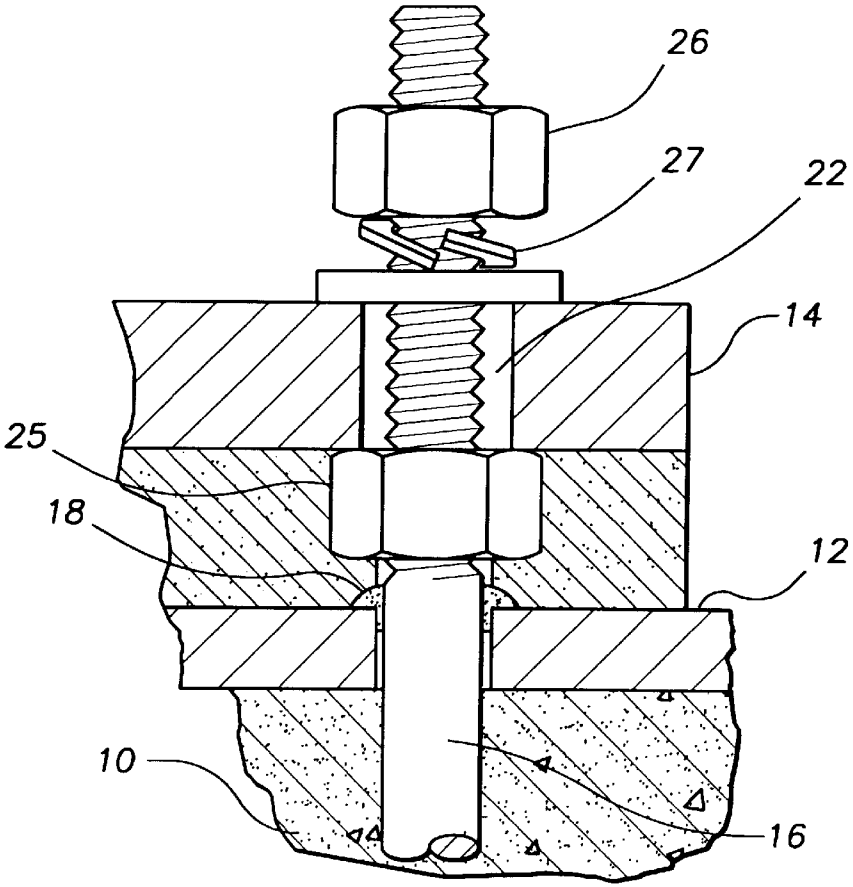
FIG. 2 is a drawing of an anchor bolt secured in the building foundation.
Figure 1:
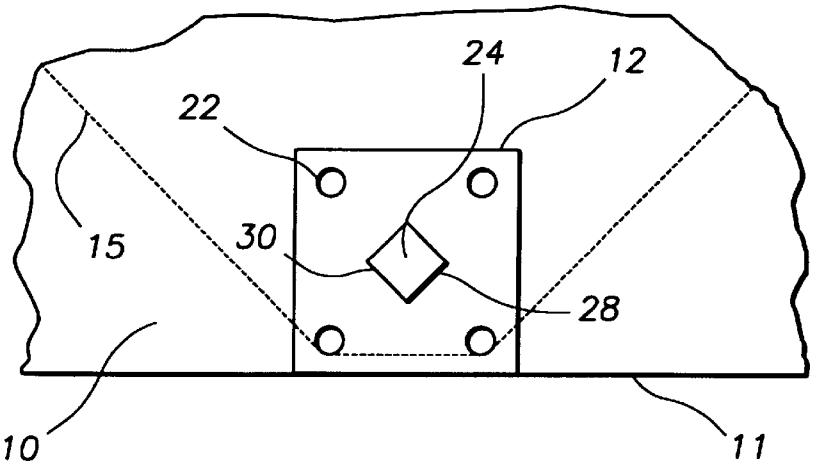
FIG. 1 is a drawing of a post support plate and building foundation.

The construction of the building of the present invention proceeds after the pouring of a foundation 10 in a manner known in the art. Before the foundation 10 (FIG. 1) has set up and hardened, a ⅛" thick support plate 12 having four bolts, e.g. 16 (FIG. 2), spot welded to the plate 12, is laid on the upper surface of the foundation 10; the front edge of the plate 12 substantially coinciding with the edge 11 of the foundation 10. Because the plate 12 is at the edge 11 of the foundation 10, prior to placing the plate 12, a section of rebar 15 is pressed into the foundation 10 in the vicinity of the plate 12 to stabilize the foundation 10. The lower portions of the four bolts, e.g. 16, extending through the plate 12 secure the plate 12 in the hardened concrete of the foundation 10. The bolts, e.g. 16 are joined to the plate 12 by fillet welds, e.g. 18. A 1⅜" thick post mounting plate 14 is configured for placement over the plate 12 and bolts, e.g. 16 (FIG. 2). The upper portions of the bolts, e.g. 16, extend through holes, e.g. 22, in the post mounting plate 14 which has a vertical structural steel post 24 welded to its center. Nuts, e.g. 26, and lock washers, e.g. 27 on the upper portion of the bolts, e.g. 16, bear against the upper surface of the post mounting plate 14, and leveling nuts, e.g. 25, on the bolts e.g. 16, bear against the underside of the post mounting plate 14. Cinching down on the nuts, e.g. 26, anchors the post 24 to the foundation 10 by means of the post mounting plate 14 and the support plate 12. The orientation of the post mounting plate 14 may be adjusted by means of the four leveling nuts, e.g. 25, so the structural steel post 24 is vertically plumb.

Figure 3:
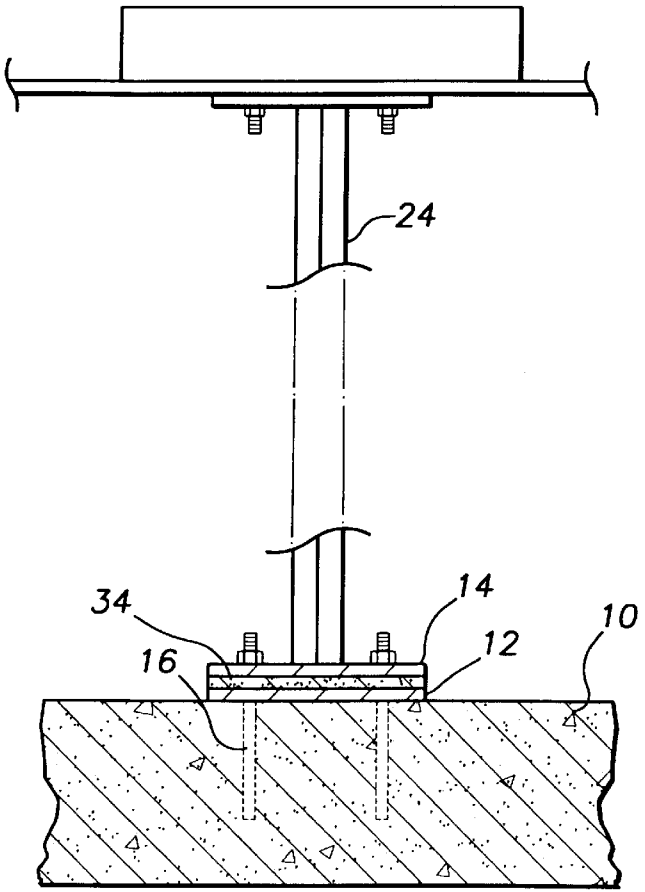
FIG. 3 is a drawing of a post mounted on the building foundation.

The post 24 (FIG. 3) is approximately 7'–10' long, fabricated from 3/16" inch steel, and has a cross-section of 4"×4" with a hollow interior cavity running the full length of the post. The post 24 is relatively light weight, and is readily handled and moved into position by two men. The post 24 is oriented on its mounting plate so that the planar faces 28,30 (FIG. 1) of the post are at a 45 degree angle with respect to the edge of the post support plate 14, and accordingly, when a post 24 is installed on the foundation 10, the faces 28,30 of the post are at a 45 degree angle with respect to the edge 11 of the foundation.

With a post 24 firmly in place on the foundation 10, the hollow cavity is filled from the top with concrete 32, (it takes about ¾ of a cubic foot to fill a 7' post), which is readily poured by one man. Non-shrink grout 34 is also poured between the support plate 12 and the post mounting plate 14 so that the leveling nuts, e.g. 25, will be encased in a solid matrix after the grout 34 has hardened.

In the house built according to the invention, wall, ceiling, and roof structural support requires use of a comparatively small number of concrete reinforced posts 24 which may be spaced along the foundation 10 at up to 20' intervals. This significantly reduces the amount of material and labor required compared to other home construction techniques.

Figure 4:
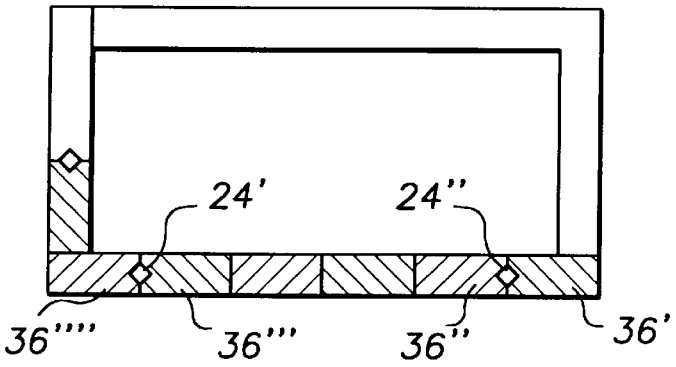
FIG. 4 is a drawing illustrating straw bales and posts forming the building perimeter.
Figure 5:
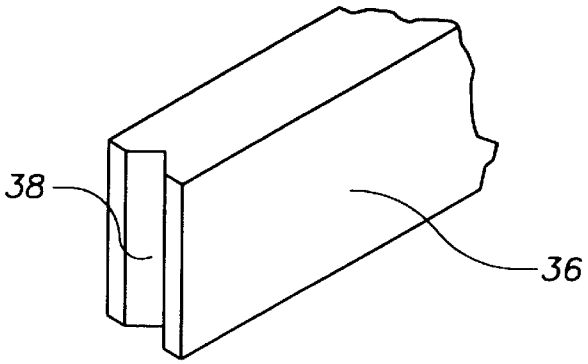
FIG. 5 is a drawing illustrating a straw bale having a notched end face.

As stated above, each square post 24 is oriented relative to the plate on which it is mounted so that the faces of the post make 45 degree angles with the edges of the plate 14 and with the edge 11 of the foundation 10. This simplifies mating a bale with a post when building up the wall core. The typical dimensions of a bale are approximately 36"× 18"×14" and bales are stacked around the perimeter in building up the wall core. A bale 36 that engages a post has a right angled prismatically shaped piece, 4" on a side, 38 cut out from the center of its end face. (FIG. 5) This is easily done with only two cuts of a handsaw or a chain saw, compared to three more difficult cuts which would be required if the post edges ran parallel to the foundation edge. Referring to FIG. 4, where possible the distance between posts 24',24" is set approximately equal to a multiple of a bale length, so that an integral number of bales 36',36",36"',36"", fit between posts 24',24". (In the drawings, corresponding elements are designated by the same reference number, albeit that they are differentiated by primes). The bale is slid into position so that the cut out segment in the bale encompasses the right angle apex of the post corner and the bale cut out section is fully and snugly in contact with two faces of the post. The wall core is built up by stacking bales in courses along the perimeter starting at the foundation level. Door and window locations are provided in the wall core by cutting the bales either before or after they are positioned in the wall.

Figure 6:
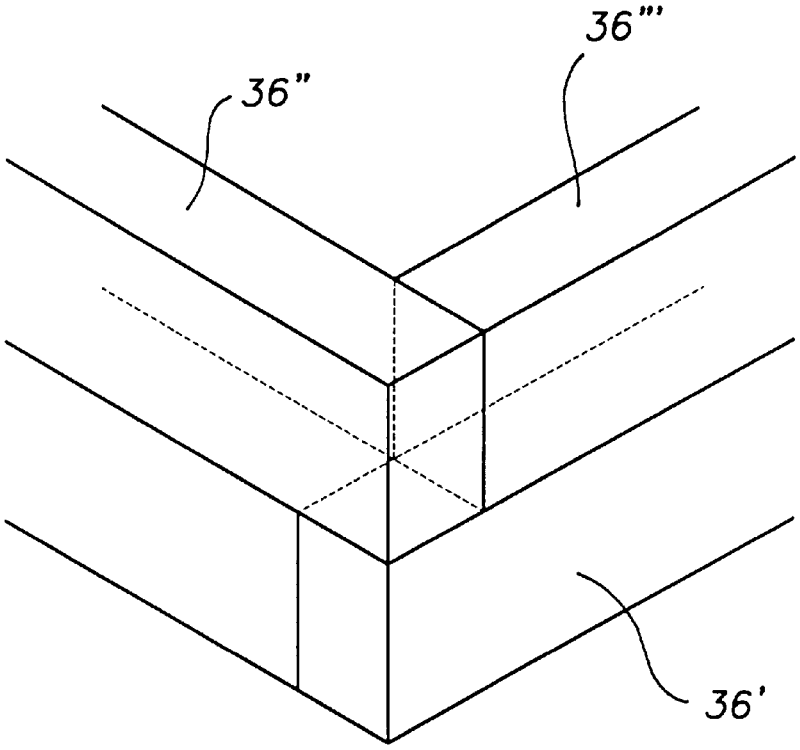
FIG. 6 is a drawing of straw bales assembled as a corner.

It will be noted that posts are not located at the corners of the structure, but are set back from the corner by at least one bale's length. This allows the stacking of bales of standard length in fabricating a corner, without the need of special tailoring cuts in the bales that would be otherwise required (FIG. 6).

Figure 7:
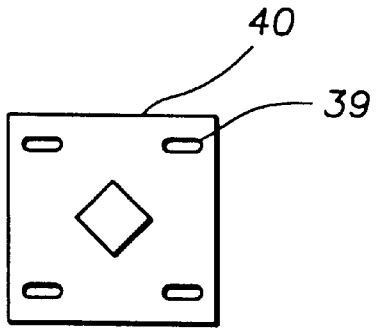
FIG. 7 is a drawing of a plate used at the top of a post.
Figure 8:
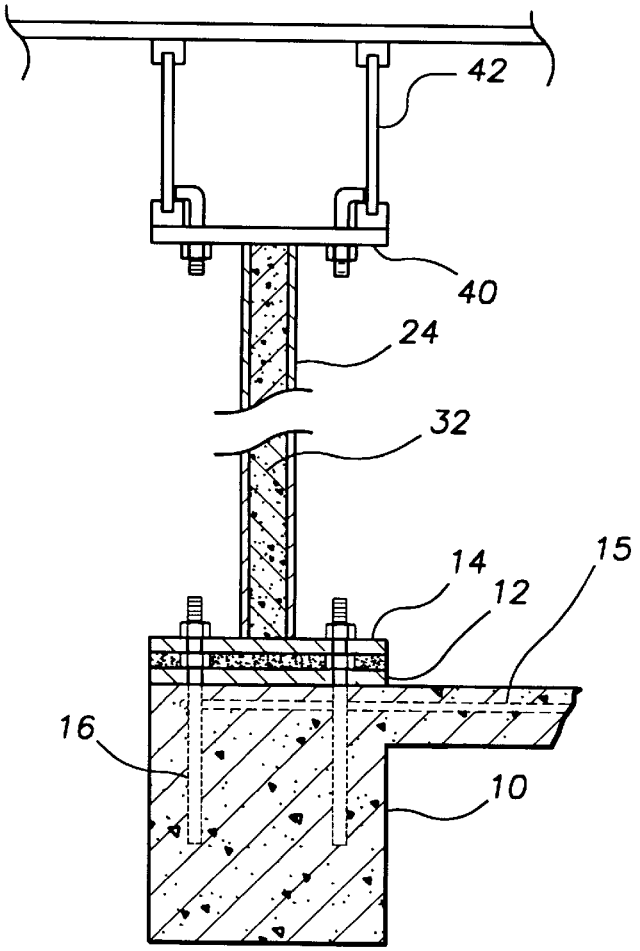
FIG. 8 is a drawing showing a mounted post having a wooden assembly secured to its top surface.
Figure 9:
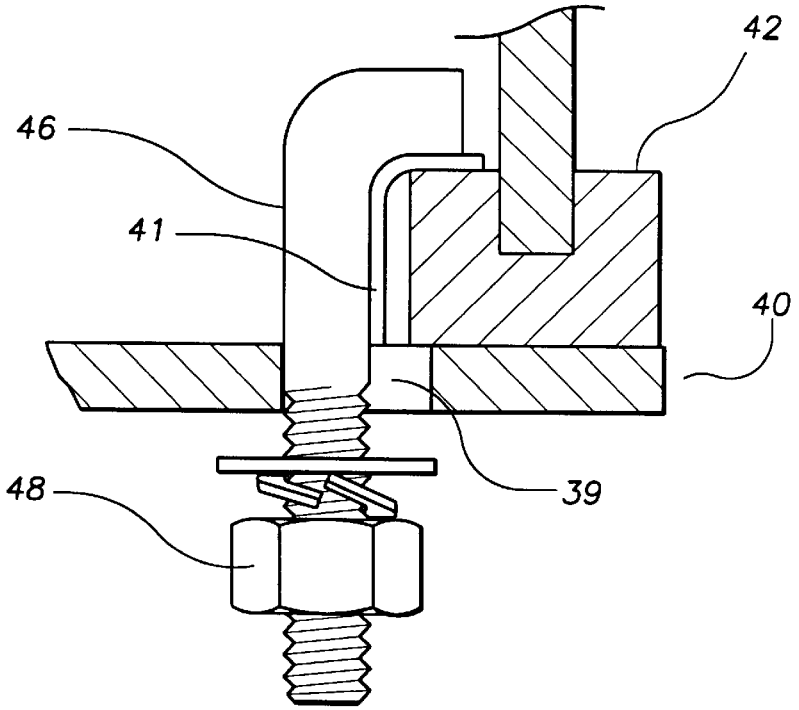
FIG. 9 is a drawing showing a hook piece securing a wooden assembly to the top of a post and, FIG. 10 is a drawing of a second embodiment of the invention utilizing a hollow unfilled post.
Figure 10:
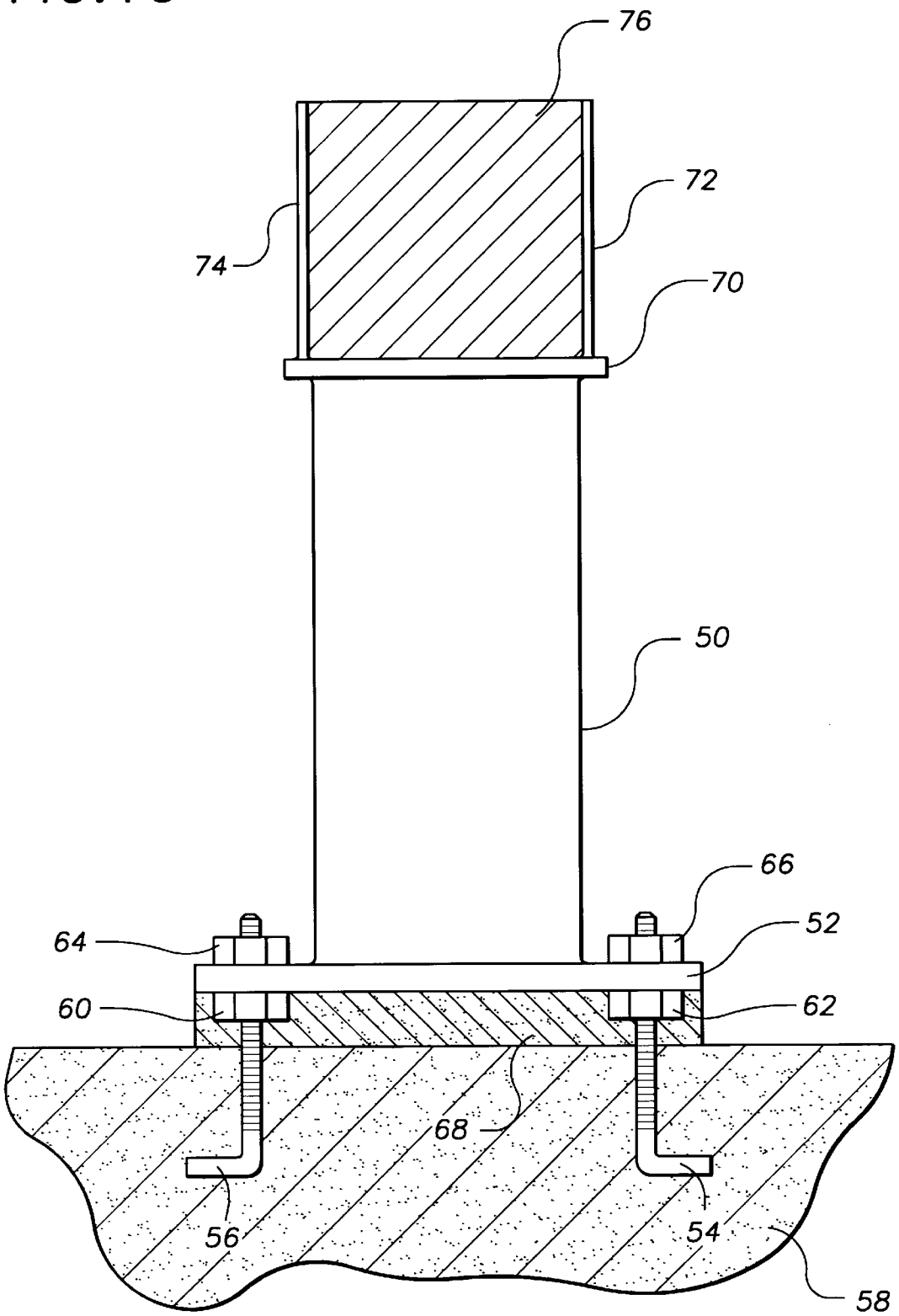

To provide support for the ceilings and roof trusses, a TJI assembly is attached to a plate 40 welded to the top of each post 24 (FIGS. 7,8). The TJI unit 42 is a wooden box shaped assembly, commercially available from companies such as the Trus-Joist MacMillan Corp., Boise, Id. Securing the TJI assembly 42 to the plate 40 (FIG. 9) are 4 hooks, e.g. 46 which bear down on angle brackets, e.g. 41 against the bottom surfaces of the TJI assembly 42. The angle brackets, e.g. 41, distribute the force exerted by the hooks, e.g. 46, and keep the TJI surface from being gouged by the pressure exerted by the hooks. The shank portions of the hooks, e.g. 46 are threaded, and fit into slotted holes, e.g. 39, in the plate 40 allowing the hooks to be shifted relative to the angle brackets, e.g. 41, prior to tightening the hooks, e.g. 46, in position by means of nuts, e.g. 48. The TJI units, e.g. 42, serve as anchoring points for ceiling joists and roof trusses used to complete the structure of the building in a manner known in the art.

In a second embodiment of the invention, hollow steel posts, e.g. 50, not filled with concrete are used as structural support members. For adequate structural strength, the steel posts are fabricated in square hollow shape from 3/16" thick steel and are at least 6"×6" on a side. The posts e.g. 50 are welded to steel bottom plates, e.g. 52. Anchor bolts, e.g. 54, 56 are inserted into the concrete foundation 58, before the concrete has set. After the concrete has set and the anchor bolts e.g. 54, 56 are firmly fixed in the foundation 58, levelling nuts, e.g. 60,62 are threaded onto the anchor bolts, e.g. 54,56, and the posts e.g. 50 and their bottom plates e.g. 52 are mounted so that the anchor bolts e.g. 54,56 pass through holes in the bottom plates e.g. 52. Top nuts e.g. 64,66 are then threaded onto the anchor bolts e.g. 54,56, and the levelling nuts e.g. 60,62 are adjusted as the top nuts e.g. 64,66 are tightened so that the posts e.g. 50 are plumbed into a vertical position and securely fixed to the foundation 58. The regions e.g. 68 below the bottom plates e.g. 52 and the foundation 58 are filled with non-shrink grout. Top plates e.g. 70 are welded to the upper ends of the posts e.g. 50, and two steel side plates e.g. 72,74 are welded to the top plates e.g. 70. TJI assemblies, e.g. 76, previously described, are mounted between the side plates, e.g. 72,74 and are secured by nails through the side plates.

The invention has been described in detail with particular reference to preferred embodiments thereof, but it will be understood that variations and modifications can be effected within the spirit and scope of the invention.

What is claimed is:

1. A building structural system comprising:

a) a multiplicity of structural longitudinally extending posts adapted to be vertically erected, each of said posts having an upper end and a lower end, b) means for leveling said posts to a plumb orientation when vertically erected, said means for leveling located below said lower end of each of said posts, c) a multiplicity of bales comprising fibrous material, each of said bales substantially in the form of a rectangular parallelepiped having planar rectangular end faces, wherein said bales include means for engagement with said posts, said means for engagement are notches in said end faces of said bales, said notches in said end faces engage said posts wherein said bales are laid in courses to form the walls of said building and said end faces of pairs of said bales meeting at said post are facially in contiguous contact, and d) means for supporting roof beams and trusses attached to said upper end of each of said posts, said means for supporting roof beams and trusses carrying the load of said roof beams and trusses, said walls further being non load bearing walls.

2. The system of claim 1 wherein said fibrous material is straw.

3. The system of claim 1 wherein said posts have square cross sections.

4. The system of claim 1 wherein said posts are steel posts.

5. The system of claim 1 wherein said posts are hollow posts, whereby the hollows of said posts are fillable with concrete.

6. The system of claim 1 wherein said means for engagement of said posts are notches cut in said end faces of said bales.

7. The system of claim 6 wherein said notches are triangularly prismatic in shape.

8. A method of fabricating a building on a foundation comprising the steps of:

a) securing a multiplicity of hollow longitudinally extending posts each having an upper end and a lower end, vertically onto said foundation, b) leveling said posts in a plumb orientation, c) filling said hollow upright posts with concrete, d) laying courses of bales, said bales having the shape of rectangular parallelepipeds with rectangular end faces, said bales being further of fibrous materials, said bales being laid above and along said foundation, wherein said courses of bales form the walls of said building, e) notching the end faces of said bales to form notches in said end faces, wherein said notches in said end faces of said bales engage said posts and further wherein said end faces of said bales contiguously contact each other, and f) securing roof beams and trusses to said upper ends of said posts, said posts bearing the load of said roof beams and trusses, said walls further being non load bearing walls.

9. The method of claim 8 wherein said posts are spaced along said foundation at integral multiples of the length of said bales.

10. The method of claim 8 wherein said posts are positioned on said foundation at a distance of at least one bale length from a corner of said foundation.

11. A method of fabricating a building on a foundation comprising the steps of:

a) securing a multiplicity of hollow longitudinally extending posts, each of said posts having an upper end and a lower end, vertically onto said foundation, said posts having square cross-sections, said posts further each comprising four rectangular longitudinally extending surfaces, b) leveling said posts in a plumb orientation, c) filling said hollow upright posts with concrete, d) laying courses of bales, said bales having the shape of rectangular parallelepipeds with rectangular end faces, said bales further being of fibrous materials, said bales being laid above and along said foundation, wherein said course of bales form the walls of said building, e) notching the end faces of said bales to form notches in said end faces, wherein said notches in said end faces of said bales engage said posts and further wherein said end faces of said bales contiguously contact each other, and f) securing roof beams and trusses to said upper ends of said posts, said posts bearing the load of said roof beams and trusses, said walls further being non load bearing wall.

12. The method of claim 11 wherein said posts are spaced along said foundation at integral multiples of the length of said bales.

13. The method of claim 11 wherein said posts are oriented so that said surfaces of said square cross-section posts are at a 45 degree angle with the longitudinal direction of said foundation.

14. The method of claim 13 wherein said bales are notched in a triangularly prismatic form of an angle of 90 degrees for engagement at said posts.

15. The method of claim 11 wherein said posts are positioned on said foundation at a distance of at least one bale length from a corner of said foundation.

16. A building structural system comprising:

a) a multiplicity of structural longitudinally extending posts adapted to be vertically erected, said posts being of steel material at least 3/16" thick, said posts further having square, hollow, unfilled cross-sections, said posts being at least 6" by 6" on a side, each of said posts having an upper end and a lower end, b) means for leveling said posts to a plumb orientation when vertically erected, said means for leveling located below said lower end of each of said posts, c) a multiplicity of bales comprising fibrous material, each of said bales substantially in the form of a rectangular parallelepiped having planar rectangular end faces, wherein said bales include means for engagement with said posts, said means for engagement are notches in said end faces of said bales, said notches in said end faces engage said posts wherein said bales are laid in courses to form the walls of said building and said end faces of pairs of said bales meeting at said posts are facially in contiguous contact, and d) means for supporting roof beams and trusses attached to said upper end of each of said posts said means for supporting roof beams and trusses carrying the load of said roof beams and trusses, said walls further being non load bearing walls.

17. The system of claim 16 wherein said fibrous material is straw.

18. The system of claim 16 wherein said means for engagement of said posts are notches cut in said end faces of said bales.

19. The system of claim 18 wherein said notches are triangularly prismatic in shape.

20. A method of fabricating a building on a foundation comprising the steps of:

a) securing a multiplicity of structural longitudinally extending posts, each of said posts having an upper end and a lower end, vertically onto said foundation, said posts being of steel sheet material at least 3/16" thick, said posts further having square, hollow, unfilled cross-sections, said posts further each comprising four rectangular longitudinally extending surfaces, wherein said square posts are at least 6" by 6" on the sides perpendicular to the longitudinal direction of said posts, b) leveling said posts in a plumb orientation, c) laying courses of bales, said bales having the shape of rectangular parallelepipeds having rectangular end faces, said bales further being of fibrous materials, said bales being laid above and along said foundation, wherein said courses of bales form the walls of said building, d) notching the end faces of said bales to form notches in said end faces, wherein said notches in said end faces of said bales engage said posts and further wherein said end faces of said bales contiguously contact each other, and e) securing roof beams and trusses to said upper ends of said posts, said posts bearing the load of said roof beams and trusses, said walls further being non load bearing walls.

21. The method of claim 20 wherein said posts are spaced along said foundation at integral multiples of the length of said bales.

22. The method of claim 20 wherein said posts are positioned on said foundation at a distance of at least one bale length from a corner of said foundation.

23. The method of claim 20 wherein said posts are oriented so that said surfaces of said square cross-section posts are at a 45 degree angle with the longitudinal direction of said foundation.

24. The method of claim 20 wherein said bales are notched in a triangularly prismatic form of an angle of 90 degrees for engagement at said posts.

* * * * *